US007963803B1

(12) United States Patent
Yang

(10) Patent No.: US 7,963,803 B1
(45) Date of Patent: Jun. 21, 2011

(54) BATTERY CONNECTOR WITH BOARD LOCK

(75) Inventor: Chih-Lin Yang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/705,547

(22) Filed: Feb. 12, 2010

(51) Int. Cl.
*H01R 33/00* (2006.01)

(52) U.S. Cl. ..... 439/627

(58) Field of Classification Search ..... 439/567, 439/489, 570–571, 573, 79, 872, 627
See application file for complete search history.

(56) References Cited

U.S. PATENT DOCUMENTS 6,086,418 A * 7/2000 Chang ..... 439/573
6,270,379 B1 * 8/2001 Huang et al. ..... 439/660
6,287,146 B1 * 9/2001 Avery et al. ..... 439/607.4
6,454,599 B1 * 9/2002 Wu ..... 439/567
6,540,553 B1 * 4/2003 Wu ..... 439/567
6,638,105 B1 * 10/2003 Wu ..... 439/567
7,473,110 B1 * 1/2009 Wu et al. ..... 439/79

* cited by examiner

*Primary Examiner* — Jean F Duverne
(74) *Attorney, Agent, or Firm* — Cheng-Ju Chiang

(57) ABSTRACT

A battery connector includes an insulating housing, a plurality of contacts engaged into the insulating housing along a vertical direction and a pair board lock engaged into the insulating housing along a horizontal direction. The insulating housing includes a plurality of contact slits defined at a front surface thereof, extended towards a rear surface thereof and penetrated a bottom surface thereof, and a pair of fixing slits defined at the rear surface and penetrated the bottom surface. Each contact includes a contact plate protruded from the front surface and a soldering leg protruded from the bottom surface. Each board lock includes a pair of locking legs protruded from the bottom surface. Because the contacts and the board locks are engaged with the insulating housing along two directions to improve the strength of the battery connector to against a lateral force applied on the contacts.

7 Claims, 7 Drawing Sheets

BATTERY CONNECTOR WITH BOARD LOCK

BACKGROUND OF THE INVENTION

1. Field of the Invention

The present invention relates to a battery connector, more specifically, to a battery connector with a board lock capable of mounting the battery connector on a printed circuit board.

2. The Related Art

Nowadays, a consumer product, such as a portable notebook, a digital camera, etc, equips with a battery capable of providing power energy for long-term use. The consumer product includes a printed circuit board configured therein and a battery connector mounted on the printed circuit board for connecting the battery. The power energy of the battery will be provided to the printed circuit board of the consumer product through the battery connector.

Please refer to FIG. 1. A conventional battery connector 800 mounted on a printed circuit board 900 including an insulating housing 802 and a plurality of contacts 804 (only shown one contact). The insulating housing 802 is mounted on the printed circuit board 900. The contacts 804 are engaged with and received in the insulating housing 2. Each contact 804 includes a contact portion 806 and a soldering portion 808 protruded from the insulating housing 2.

The contact portion 806 of the contact 804 is projected from a lateral side of the insulating housing 802 for connecting a battery 700. The soldering portion 808 is horizontally extended from a bottom portion of the insulating housing 802 for being soldered onto the printed circuit board 900.

Hence, the battery connector 800 is fixed on the printed circuit board 900 via the soldering portion 808 of the contact 804 soldered onto the printed circuit board 900. If the battery 700 presses and connects to the contact portion 806 of the contact 804 of the battery connector 800 from the lateral side of the battery connector 800, the battery connector 800 will sustain a lateral force from the battery 700.

Hence, the soldering portion 808 of the contact 804 will be broken after long-term used. Especially, the soldering portion 808 of the contact 804 will easy be broken if the consumer product is struck. The contact 804 of the battery connector 800 will apart from the printed circuit board 900 to make the consumer product erroneously working.

Another conventional battery connector includes a vertical soldering portion of the contact for being inserted into a fixing hole defined at the printed circuit board to improve the engaging force between the battery connector and the printed circuit board. If the battery connector sustains the lateral force from the battery, the lateral force will focus at the vertical soldering portion of the contact. Hence, the vertical soldering portion of the contact will become deformed. Hence, the consumer product will erroneously work.

SUMMARY OF THE INVENTION

An object of the present invention is to provide a battery connector.

According to the invention, the battery connector includes an insulating housing, a plurality of contacts and a pair of board locks. The insulating housing defines a front surface, a rear surface opposite to the front surface and a bottom surface connected to the front surface and the rear surface.

The front surface defines a plurality of contact slits extended towards the rear surface and penetrated a bottom surface. The rear surface defines a pair of fixing slits penetrated the bottom surface. The contacts are received into the contact slits along a vertical direction from the bottom surface of the insulating housing. Each contact includes a contact plate protruded from the front surface of the insulating housing and a soldering leg protruded from the bottom surface of the insulating housing.

The board locks are engaged into the fixing slits along a horizontal direction from the rear surface of the insulating housing. Each board lock includes a pair of locking legs protruded from the bottom surface and a locking protrusion protruded outward from each locking leg.

Because the contacts are engaged with the insulating housing along the vertical direction and the board locks are engaged with the insulating housing along the horizontal direction, the battery connector can be firmly fixed on the printed circuit board. Also, the strength of the battery connector will be improved to against a lateral force applied on a front edge of each contact plate thereof.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
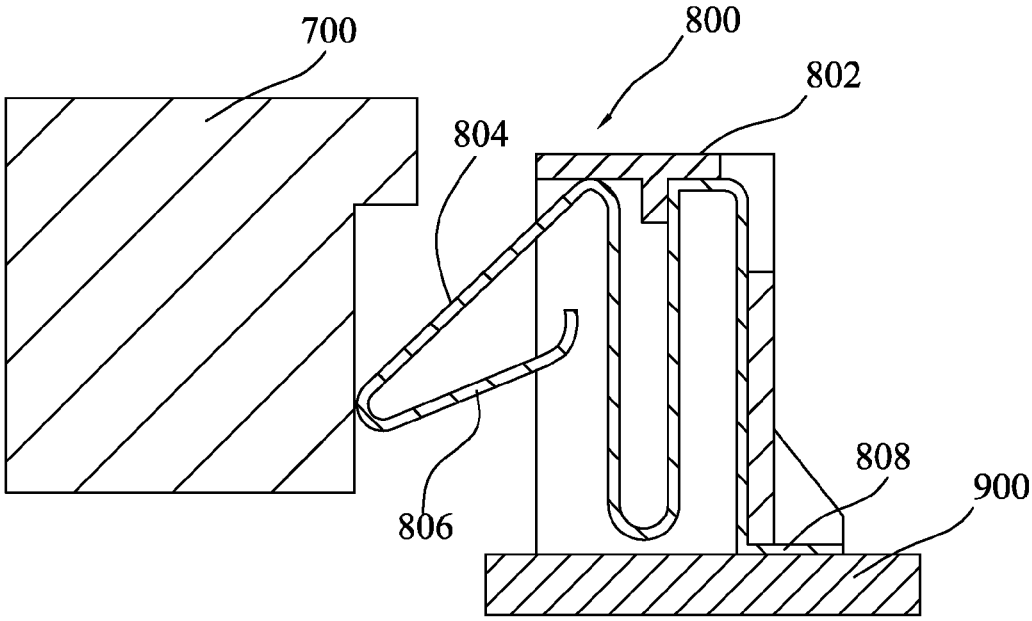
FIG. 1 (Prior Art)
FIG. 1 is a perspective view of a conventional battery connector.
Figure 2:
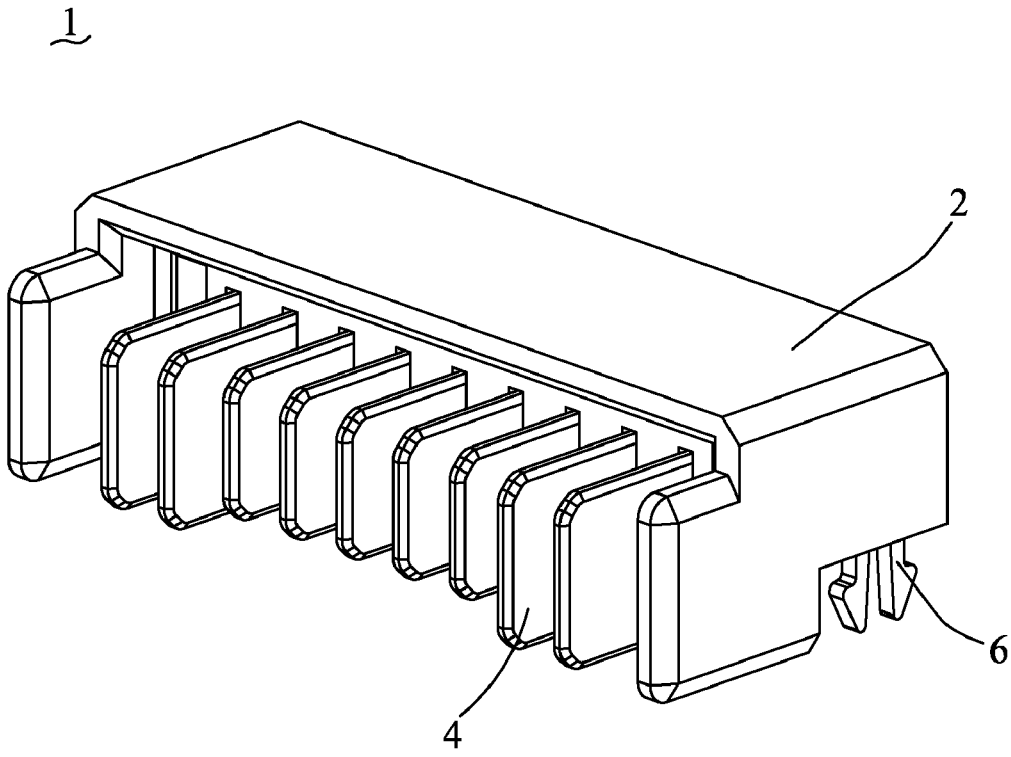
FIG. 2 is a perspective view of a battery connector seen from the top according to the present invention.
Figure 4:
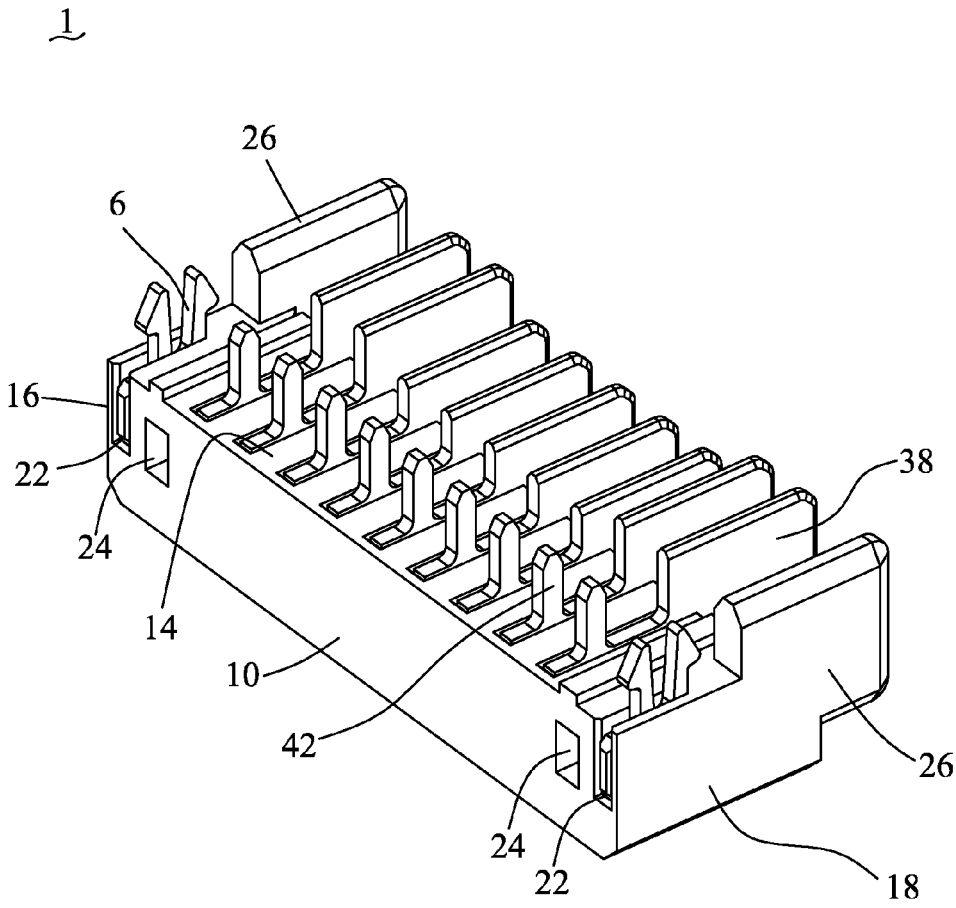
FIG. 4 is a perspective view of a battery connector seen from the bottom in FIG. 2.

Please refer to FIG. 2 and FIG. 4. A battery connector 1 according to the present invention includes an insulating housing 2, a plurality of contacts 4 and a board lock 6. The contacts 4 and the board lock 6 are engaged into the insulating housing 2.

The insulating housing 2 is formed as an elongate shape and transversely mounted on a printed circuit board (not shown in figures). The insulating housing 2 includes a front surface 8, a rear surface 10 opposite to the front surface 8, a top surface 12, a bottom surface 14 opposite to the top surface 12, a left side surface 16 and a right side surface 18 opposite to the left side surface 16.

The front surface 8 of the insulating housing 2 defines a plurality of contact slits 20 horizontally extending towards the rear surface 10. The contact slits 20 penetrate the bottom surface 14. The rear surface 10 defines a pair of fixing slits 22 and a pair of positing holes 24 beside the fixing slits 22. The fixing slits 22 is penetrated the bottom surface 14 and adjacent to the left surface 16 and the right surface 18 respectively.

The positioning holes 24 is horizontally extended towards the front surface 8 and penetrated the front surface 8. Each fixing slit 22 is formed between the each positioning hole 24 and each side surface 16, 18. The positioning holes 24 are capable of guiding a battery to contact the contacts 4. Each of the left surface 16 and the right surface 18 is extended forward and downward to form a protection plate 26 for protecting the contacts 4.

Figure 8:
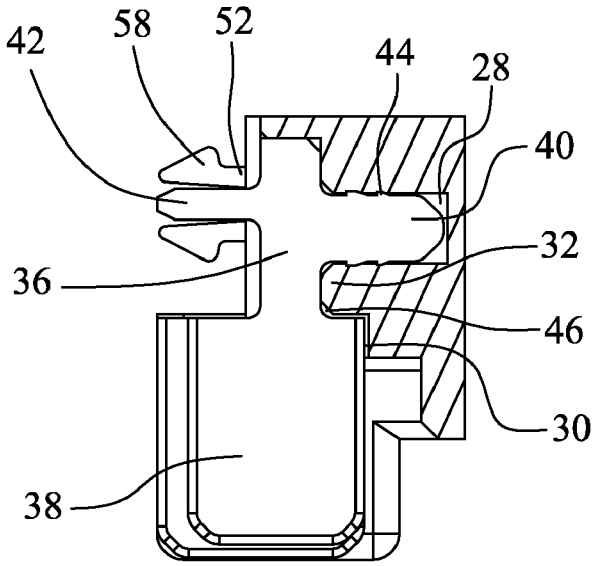
FIG. 8 shows a cross section view of the battery connector along VIII-VIII in FIG. 6.

Please refer to FIG. 8. Each of the contact slits 20 is extended upward to form an engaging channel 28. The top of each contact slit 20 is formed a cutout 30 at the front of the fixing channel 28 to form an engaging protrusion 32 between the fixing channel 28 and the cutout 30. A front of each fixing slits 22 is protruded rearward to form an engaging bulge 34 inside the fixing slit 22.

Figure 3:
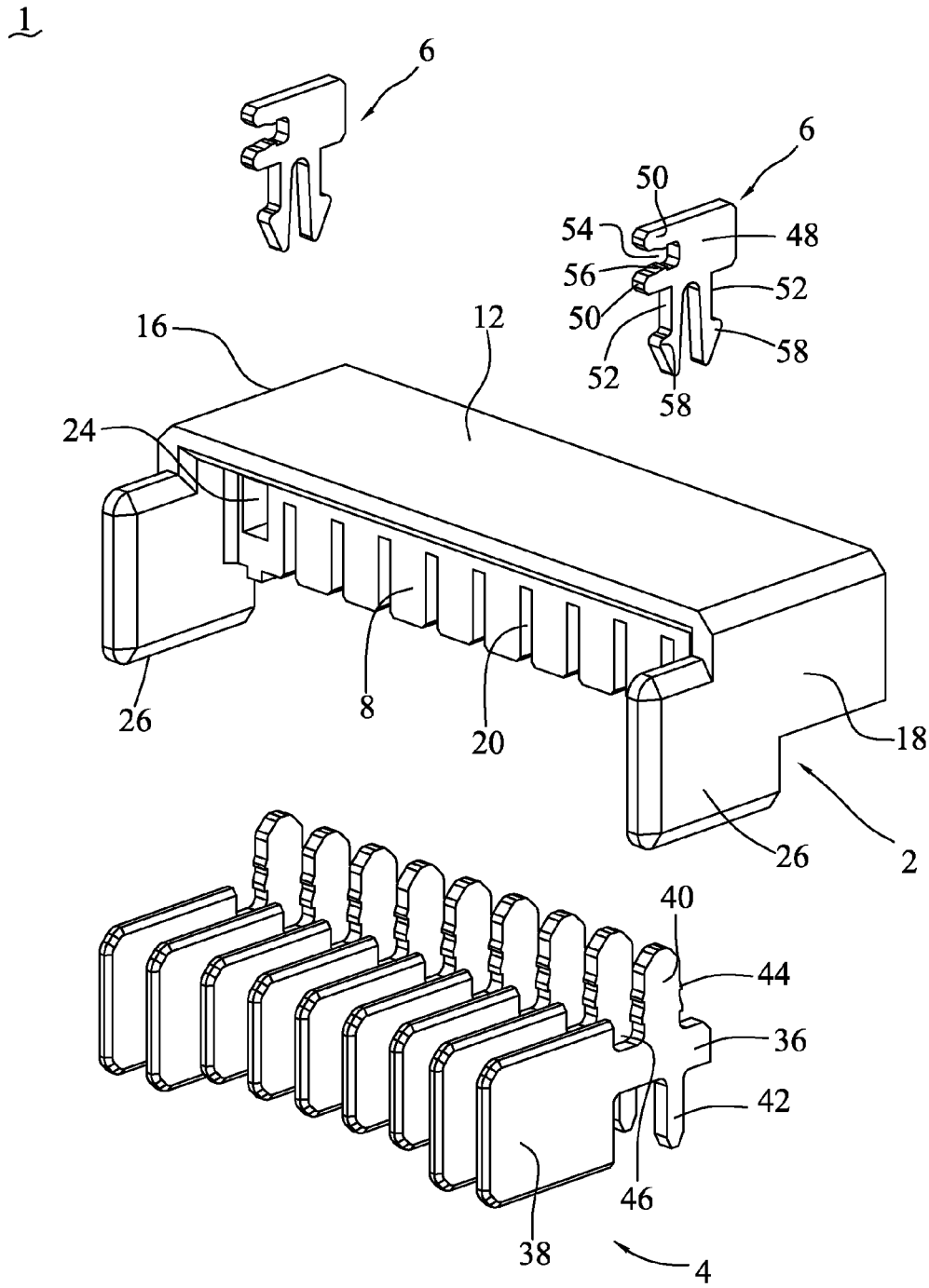
FIG. 3 is an exploded view of the battery connector seen from the top in FIG. 2.
Figure 5:
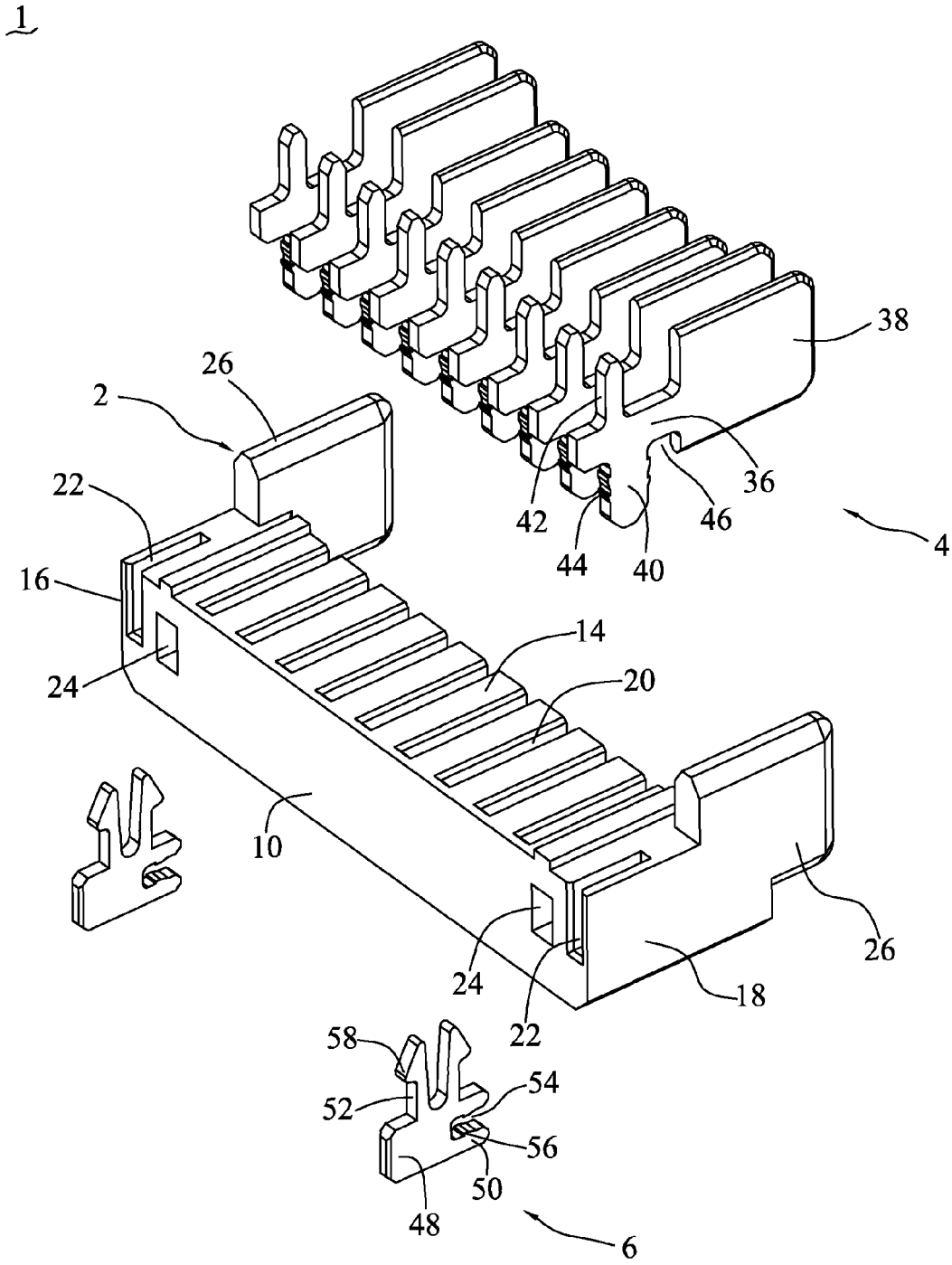
FIG. 5 is an exploded view of the battery connector seen from the bottom in FIG. 2.
Figure 6:
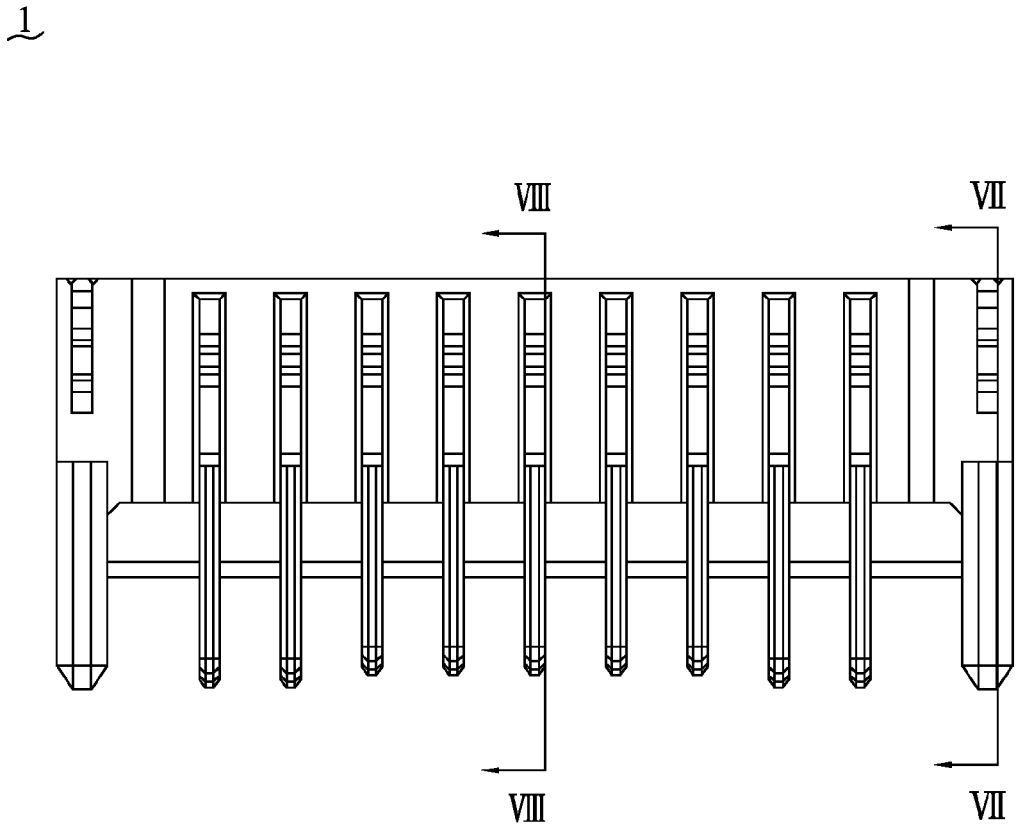
FIG. 6 is a bottom view of battery connector seen in FIG. 2.

Please refer to FIG. 3 and FIG. 5. The contacts 4 are punched from a metal foil to form a plate shape. Each of the contacts 4 includes a main plate 36, a contact plate 38 extended forward from a front edge of the main plate 36, a fixing plate 40 extended upward from a top edge of the main plate 36, a soldering leg 42 extended downward from a bottom edge of the main plate 36, and a plurality of first barbs 44 respectively protruded from a front edge and a rear edge of the fixing plate 40. A rear edge of the contact plate 38, the top edge of the main plate 36 and the front edge of the fixing plate 40 together define a first engaging recess 46.

The board locks 6 are punched from a metal foil to form a plate shape. Each of the board locks 6 includes a main board 48, a pair of fixing fingers 50 extended forward from a front edge of the main board 48 and a pair of locking legs 52 extended downward from a bottom edge of the main board 48.

The fixing fingers 50 are spaced from each other. The fixing fingers 50 and the front edge of the main board 48 together define a second engaging recess 54. Each of the fixing fingers 50 is protruded a second barb 56 inside the engaging recess 54. The locking legs 52 are spaced from each other. The free end of each locking leg 52 is protruded outwardly to form a locking protrusion 58.

Figure 7:
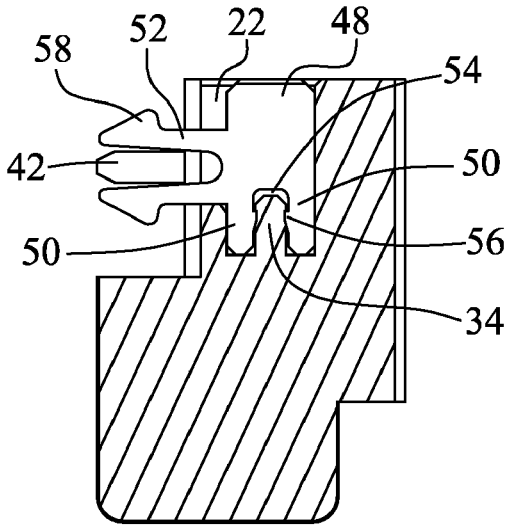
FIG. 7 shows a cross section view of the battery connector along VII-VII in FIG. 6.

Please refer to FIG. 7 and FIG. 8. If the battery connector 1 is assembled, each contact 4 can be inserted into each contact slit 20 from the bottom surface 14 of the insulating housing 2. The main plate 36 of the contact 4 is received in the contact slit 20. The fixing plate 40 is inserted into the engaging channel 28. The first barbs 44 of the fixing plate 40 are abutted against inner surfaces of the engaging channel 28.

The engaging protrusion 32 of the insulating housing 2 is engaged into the first engaging recess 46 of the contact 4. The contact plate 38 of the contact 4 is protruded from the front surface 8 of the insulating housing 2. The soldering leg 42 of the contact 4 is protruded from the bottom surface 14 of the insulating housing 2.

Each board lock 6 is inserted into each fixing slit 22 from the rear surface 10 of the insulating housing 2. The main board 48 is received in the fixing slit 22. The engaging bulge 34 of the insulating housing 2 is engaged into the second engaging recess 54 defined between the fixing fingers 50 of the board lock 6. The second barb 56 of the fixing fingers 50 are abutted against the engaging bulge 34.

The locking legs 52 of the board lock 6 are protruded from the bottom surface 14 of the insulating housing 2. The soldering legs 42 of the contacts 4 are aligned with each other to be arranged in a line along a longitudinal direction of the insulating housing 2. The soldering legs 42 of the contacts 4 are positioned between the locking legs 52 of each board lock 6 along the longitudinal direction of the insulating housing 2.

If the battery connector 1 is mounted on a printed circuit board (not shown in figures), the bottom surface 14 of the insulating housing 2 will be mounted on a mounting surface of the printed circuit board. The soldering leg 42 of each contact 4 inserted into a corresponding inserting slit defined at the mounting surface of the printed circuit board. The locking legs 52 of each board lock 6 are inserted through a corresponding engaging hole penetrating the printed circuit board from the mounting surface to an engaging surface opposite to the mounting surface. The locking protrusion 58 of each locking leg 52 is engaged with the periphery of the engaging hole formed at the engaging surface.

Because soldering legs 42 of the contacts 4 are inserted into to the inserting slits of the printed board and the fixing plates 40 of the contacts 4 are engaged into the engaging channels 28 of the insulating housing 2 along a vertical direction, the battery connector 1 can be fixed on the printed circuit board. Because the fixing fingers 50 of the board locks 6 are engaged with the engaging bulges 34 of the insulating housing therebetween along a horizontal direction and the locking legs 52 of the board locks 6 are engaged with engaging holes of the printed circuit board, the battery connector 1 can be firmly fixed on the printed circuit board.

Especially, because the contacts 4 are engaged with the insulating housing 2 along the vertical direction, the board locks 6 are engaged with the insulating housing 2 along the horizontal direction and the soldering legs 42 of the contacts 4 and the locking legs 52 of the board locks 6 are arranged in a line for engaging with the printed circuit board, the battery connector 1 can be firmly fixed on the printed circuit board. Also, the strength of the battery connector 1 will be improved to against a lateral force applied on a front edge of each contact plate 38 thereof.

Furthermore, the present invention is not limited to the embodiments described above; diverse additions, alterations and the like may be made within the scope of the present invention by a person skilled in the art. For example, respective embodiments may be appropriately combined.

What is claimed is:

1. A battery connector, comprising:

an insulating housing having a front surface, a rear surface opposite to the front surface, a top surface, a bottom surface opposite to the top surface, a right surface and a left surface opposite to the right surface, the top, bottom, right and left surfaces being defined between the front and rear surfaces of the insulating housing, comprising:

a plurality of contact slits each of which extends from the rear surface to penetrate from the bottom surface to the front surface to form a common opening therebetween; and at least two fixing slits defined at the rear surface and penetrated the bottom surface;

a plurality of contacts engaged into the contact slits of the insulating housing along a vertical direction, each of the contacts comprising:

a contact plate protruded from the front surface; and a soldering leg protruded from the bottom surface; and at least two board locks engaged into the fixing slits along a horizontal direction, each of the board locks comprising:

a pair of locking legs protruded from the bottom surface of the insulating housing; and a locking protrusion protruded outwardly from each of the locking leg;

wherein each of the contact slits extends upward into the insulating housing to form an engaging channel along a direction from the bottom surface of the insulating housing toward the top surface thereof, each of the contacts further comprises a fixing plate engaged into the engaging channel, an engaging bulge protrudes within each of the fixing slits along another direction from the front surface of the insulating housing towards the rear surface thereof, and each of the board locks further comprises a pair of fixing fingers clipping the engaging bulge therebetween.

2. The battery connector as claimed in claim 1, wherein the soldering legs and the locking legs are arranged in a line along a longitudinal direction of the insulating housing.

3. The battery connector as claimed in claim 2, wherein the locking legs are spaced away from each other, the soldering legs are arranged between the locking legs along the longitudinal direction of the insulating housing.

4. The battery connector as claimed in claim 1, wherein each of the contacts comprises a main plate received in each of the contact slits, the contact plate extends forward from a front edge of the main plate, the soldering leg extends downward from a bottom edge of the main plate, the fixing plate extends upward from a top edge of the main plate, the main plate, the contact plate and the fixing plate cooperatively define an engaging recess thereamong, and a top of a front portion of each contact slit defines a cutout to form an engaging protrusion between the engaging channel and the cutout for being engaged into the engaging recess of the contact.

5. The battery connector as claimed in claim 4, wherein each of the board locks comprises a main board, the fixing fingers are extended forward from a front edge of the main board, the locking legs extended downward from a bottom edge of the main board.

6. The battery connector as claimed in claim 5, wherein each of lateral sides of the insulating housing is extended forward and downward to form a protection plate.

7. The battery connector as claimed in claim 1, wherein a second barb protrudes from each of the fixing fingers towards another of the fixing fingers, the second barbs facing each other between the fixing fingers and being abutted against the engaging bulge, respectively.

* * * * *